US010637214B2

(12) United States Patent
Kaji

(10) Patent No.: US 10,637,214 B2
(45) Date of Patent: Apr. 28, 2020

(54) SPARK PLUG HAVING A RECESS FORMED IN AN ELECTRODE

(71) Applicant: DENSO CORPORATION, Kariya, Acihi-pref. (JP)

(72) Inventor: Yuji Kaji, Kariya (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 16/258,743

(22) Filed: Jan. 28, 2019

(65) Prior Publication Data

US 2019/0237943 A1 Aug. 1, 2019

(30) Foreign Application Priority Data

Jan. 29, 2018 (JP) ..... 2018-013055

(51) Int. Cl.

| | |
|---|---|
| ***H01T 13/39*** | (2006.01) |
| ***H01T 21/00*** | (2006.01) |
| ***H01T 13/32*** | (2006.01) |
| ***H01T 13/20*** | (2006.01) |
| ***H01T 1/22*** | (2006.01) |
| *H01T 1/00* | (2006.01) |

(52) U.S. Cl.

CPC ..... *H01T 13/39* (2013.01); *H01T 1/22* (2013.01); *H01T 13/20* (2013.01); *H01T 13/32* (2013.01); *H01T 21/00* (2013.01); *H01T 1/00* (2013.01)

(58) Field of Classification Search

CPC ..... H01T 13/39; H01T 21/00; H01T 1/00
See application file for complete search history.

(56) References Cited

U.S. PATENT DOCUMENTS

| | | | | |
|---|---|---|---|---|
| 5,051,651 | A * | 9/1991 | Kashiwara | H01T 13/32 313/139 |
| 7,615,914 | B2 * | 11/2009 | Francesconi | H01T 13/54 313/118 |
| 9,225,151 | B2 * | 12/2015 | Douglas | H01T 13/46 |
| 9,385,510 | B2 * | 7/2016 | Deguchi | H01T 13/32 |
| 9,564,740 | B2 * | 2/2017 | Niessner | H01T 13/32 |
| 2010/0133976 | A1 * | 6/2010 | Siegel | H01T 13/20 313/141 |
| 2019/0181620 | A1 * | 6/2019 | Kaji | H01T 13/16 |

FOREIGN PATENT DOCUMENTS

| | | |
|---|---|---|
| JP | 2016-051635 | 4/2016 |

* cited by examiner

*Primary Examiner* — Tracie Y Green
(74) *Attorney, Agent, or Firm* — Nixon & Vanderhye P.C.

(57) ABSTRACT

A spark plug is provided which includes a hollow cylindrical center electrode disposed inside a metal shell and a ground electrode joined to the metal shell. The ground electrode has an inner peripheral surface facing an outer peripheral surface of the center electrode. At least one of the outer periphery of the center electrode and the inner periphery of the ground electrode has formed therein at least one recess whose ends lies in a center-to-ground electrode facing region where the outer peripheral surface of the center electrode faces the inner peripheral surface of the ground electrode in a radial direction of the center electrode. This decreases voltage required by the spark plug to achieve discharge.

7 Claims, 12 Drawing Sheets

FIG.4

| DISTANCE x1 (mm) | DISTANCE x2 (mm) | REQUIRED VOLTAGE RATIO | |
|---|---|---|---|
| | | RECESS IN CENTER ELECTRODE | RECESS IN GROUND ELECTRODE |
| 0.00 | 1.43 | 1.00 | 0.98 |
| 0.00 | 1.38 | 0.98 | 0.90 |
| 0.03 | 1.33 | 0.92 | 0.89 |
| 0.08 | 1.28 | 0.89 | 0.88 |
| 0.13 | 1.23 | 0.86 | 0.88 |
| 0.28 | 1.08 | 0.84 | 0.88 |
| 0.58 | 0.78 | 0.84 | 0.88 |
| 0.88 | 0.48 | 0.85 | 0.88 |
| 1.18 | 0.18 | 0.86 | 0.88 |
| 1.33 | 0.03 | 0.89 | 0.90 |
| 1.43 | 0.00 | 0.94 | 0.95 |
| 1.78 | – | 1.00 | – |
| 2.08 | – | 1.00 | – |

FIG.5

| REQUIRED VOLTAGE RATIO | | AXIAL DIMENSION L (mm) | | | | | | | |
|---|---|---|---|---|---|---|---|---|---|
| | | 0.00 | 0.05 | 0.10 | 0.15 | 0.20 | 0.40 | 0.80 | 1.20 |
| CIRCUMFERENTIAL DIMENSION S (mm) | 0.00 | 1.00 | 1.00 | 1.00 | 1.00 | 1.00 | 1.00 | 1.00 | 1.00 |
| | 0.04 | 1.00 | 1.00 | 0.93 | 0.92 | 0.92 | 0.92 | 0.92 | 0.92 |
| | 0.06 | 1.00 | 0.99 | 0.90 | 0.89 | 0.88 | 0.88 | 0.88 | 0.88 |
| | 0.08 | 1.00 | 0.99 | 0.89 | 0.85 | 0.84 | 0.83 | 0.83 | 0.83 |
| | 0.10 | 1.00 | 0.99 | 0.89 | 0.84 | 0.82 | 0.82 | 0.81 | 0.81 |
| | 0.13 | 1.00 | 0.98 | 0.88 | 0.83 | 0.82 | 0.80 | 0.80 | 0.80 |
| | 0.17 | 1.00 | 0.98 | 0.88 | 0.83 | 0.81 | 0.79 | 0.79 | 0.79 |
| | 0.21 | 1.00 | 0.98 | 0.88 | 0.83 | 0.81 | 0.78 | 0.78 | 0.78 |
| | 0.42 | 1.00 | 0.98 | 0.88 | 0.83 | 0.80 | 0.78 | 0.77 | 0.77 |
| | 0.84 | 1.00 | 0.98 | 0.88 | 0.83 | 0.80 | 0.78 | 0.77 | 0.77 |
| | 1.26 | 1.00 | 0.98 | 0.88 | 0.83 | 0.80 | 0.78 | 0.77 | 0.77 |

| DEPTH D (mm) | REQUIRED VOLTAGE RATIO |
|---|---|
| 0.00 | 1.00 |
| 0.02 | 0.91 |
| 0.04 | 0.86 |
| 0.05 | 0.85 |
| 0.10 | 0.84 |
| 0.20 | 0.84 |

SPARK PLUG HAVING A RECESS FORMED IN AN ELECTRODE

CROSS REFERENCE TO RELATED DOCUMENT

The present application claims the benefit of priority of Japanese Patent Application No. 2018-13055 filed on Jan. 29, 2018, the disclosure of which is incorporated herein by reference.

BACKGROUND

1 Technical Field

This disclosure relates generally to a spark plug.

2 Background Art

Japanese Patent First Publication No. 2016-51635 discloses a spark plug which is equipped with a cylindrical center electrode and an annular ground electrode. The ground electrode is disposed to have an inner peripheral surface facing an outer peripheral surface of the center electrode. The ground electrode has a front end which is located farther away from a base end of the spark plug than a front end of the center electrode is. This facilitates concentration of electric field on the outer peripheral surface of the center electrode, thus resulting in a decrease in voltage required to create discharge in the spark plug.

The spark plug, as taught in the above publication, has the front end surface of the ground electrode which is located closer to the front side of the spark plug than the front end surface of the center electrode to concentrate the electric field on the front end of the outer peripheral surface of the center electrode. It is, however, required to further decrease the voltage required to create discharge in the spark plug. There is, thus, still room for improvement in the structure of the spark plug.

SUMMARY

It is an object of this disclosure to provide a spark plug designed to decrease voltage required to achieve discharge in the spark plug.

According to one aspect of this disclosure, there is provided a spark plug which comprises: (a) a hollow cylindrical metal shell; (b) a cylindrical center electrode disposed in the metal shell; (c) a ground electrode which is joined to the metal shell and has a cylindrical inner peripheral surface facing an outer peripheral surface of the center electrode; and (d) at least one recess which is formed in at least one of an outer periphery of the center electrode and an inner periphery of the ground electrode.

The recess has ends lying within a center-to-ground electrode facing region where the outer peripheral surface of the center electrode faces the inner peripheral surface of the ground electrode in a radial direction of the center electrode.

In the above structure, the cylindrical center electrode is disposed inside the cylindrical metal shell. The ground electrode is joined to the metal shell and has the inner peripheral surface facing the outer peripheral surface of the center electrode, so that a spark is created between the outer peripheral surface of the center electrode and the inner peripheral surface of the ground electrode.

The recess is formed in at least one of the outer periphery of the center electrode and the inner periphery of the ground electrode. The recess has the ends lying in the center-to-ground electrode facing region where the outer peripheral surface of the center electrode faces the inner peripheral surface of the ground electrode in the radial direction of the center electrode. This enhances concentration of electrical field on the ends of the recess, thereby facilitating emission of electrons from the center electrode. This results in a decrease in voltage required by the spark plug to achieve discharge. When one of the ends of the recess lies outside the center-to-ground electrode facing region in the axial direction of the center electrode, it will result in an increased distance between that end of the recess and the other of the center electrode and the ground electrode, which leads to a difficulty in developing the discharge as compared with when the recess lie fully within the center-to-ground electrode facing region In the preferred mode of this disclosure, a plurality of recesses are formed in at least one of the outer periphery of the center electrode and the inner periphery of the ground electrode. The recesses are arranged at given intervals away from each other in a circumferential direction of a corresponding one of the ground electrode and the center electrode. This results in an increase in places which are arranged in the circumferential direction and where electric field concentrates. This also results in a decrease in voltage required to achieve discharge in the spark plug.

In the second preferred mode, the recess extends over an entire circumference of one of the outer periphery of the center electrode and the inner periphery of the ground electrode. This results in an increase in area in the circumferential direction where the electrical field concentrates, thereby decreasing the voltage required by the spark plug to achieve the discharge.

In the third preferred mode, the recess has a circumferential dimension of 0.06 mm or more and an axial dimension of 0.10 mm or more. The recess has a dimension in an axial direction of a corresponding one of the ground electrode and the center electrode so as to have the ends coinciding with or inside ends of the center-to-ground electrode facing region in the axial direction. The recess has a depth of 0.04 mm or more. These dimensions have been found by the inventor of this application to contribute to a further decrease in voltage required by the spark plug to achieve the discharge.

In the fourth preferred mode, the recesses are arranged at a given interval away from each other in an axial direction of one of the center electrode and the ground electrode. This results in an increase in places which are arranged in the axial direction and where electric field concentrates. This also results in a decrease in voltage required to achieve discharge in the spark plug.

In the fifth preferred mode, the recess is formed in the outer periphery of the center electrode. This facilitates ease with which the recess is machined from outside the center electrode.

In the sixth preferred mode, the recesses are formed in the outer periphery of the center electrode and the inner periphery of the ground electrode. This results in increase in areas of the center electrode and the ground electrode where the electrical field concentrates, thereby decreasing the voltage required by the spark plug to achieve the discharge.

According to another aspect of this disclosure, there is provided a spark plug which comprises: (a) a hollow cylindrical metal shell; (b) a cylindrical center electrode disposed in the metal shell; (c) a ground electrode which is joined to the metal shell and has a cylindrical inner peripheral surface facing an outer peripheral surface of the center electrode; and (d) at least one recess which is formed in an outer periphery of the center electrode.

The recess has at least a portion lying within a center-to-ground electrode facing region where the outer peripheral surface of the center electrode faces the inner peripheral surface of the ground electrode in a radial direction of the center electrode.

In the above structure, the recess is formed in the outer periphery of the center electrode. The recess is shaped to have at least a portion lying the center-to-ground electrode facing region where the outer peripheral surface of the center electrode faces the inner peripheral surface of the ground electrode in the radial direction of the center electrode.

The outer peripheral surface of the center electrode of the spark plug has a radius of curvature smaller than the inner peripheral surface of the ground electrode. The center electrode has the recess formed in the outer periphery thereof, thereby enhancing the concentration of electrical field on an end of the recess lying within the center-to-ground electrode facing region in the axial direction of the center electrode, which facilitates emission of electrons from the center electrode, thereby resulting in a decrease in voltage required to create discharge in the spark plug.

In the preferred mode, the recess may extend to at least one of ends of the center-to-ground electrode facing region in an axial direction of the center electrode. This results in an increase in area where the electrical field concentrates, thereby decreasing the voltage required by the spark plug to achieve the discharge.

BRIEF DESCRIPTION OF THE DRAWINGS

The present invention will be understood more fully from the detailed description given hereinbelow and from the accompanying drawings of the preferred embodiments of the invention, which, however, should not be taken to limit the invention to the specific embodiments but are for the purpose of explanation and understanding only.

In the drawings:

FIG. 4 is a table which represents a relation between a location of a recess and a ratio of voltage required by a spark plug to create sparks to a reference voltage;

FIG. 5 is a table which represents a relation between dimensions of a recess and a ratio of voltage required by a spark plug to create sparks to a reference voltage;

DESCRIPTION OF THE PREFERRED EMBODIMENTS

The spark plug 10 for use in an internal combustion engine according to the first embodiment will be described below with reference to the drawings.

Figure 1:
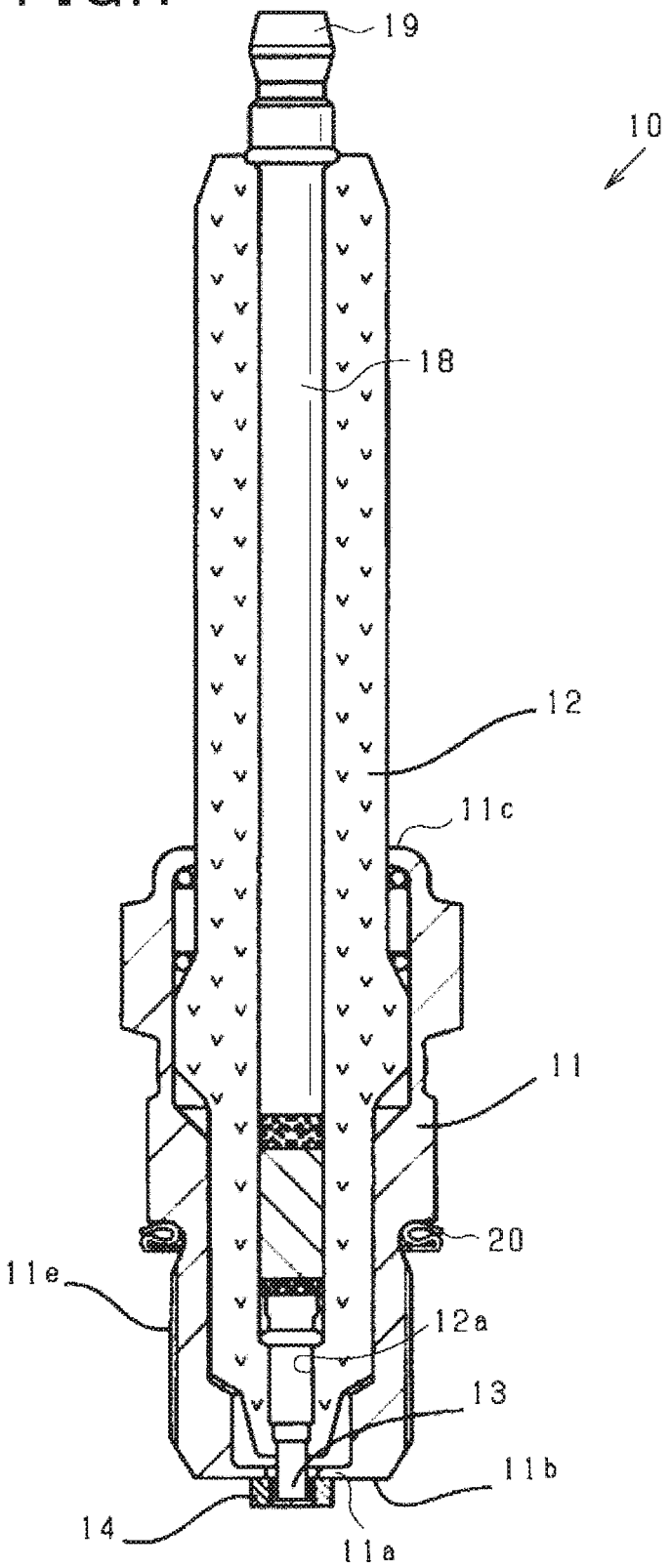
FIG. 1 is a longitudinal sectional view which illustrates a spark plug according to an embodiment.

The spark plug 10 is, as illustrated in FIG. 1, equipped with the hollow cylindrical housing 11 made of metallic material such as iron. The housing 11 is designed as a metal shell and has the thread 11*e* formed on an outer periphery of a lower portion thereof. The housing 11 has a lower end portion shaped as the small-diameter portion 11*a* which is smaller in inner diameter than another portion thereof. The housing 11 also has the flat front end surface 11*b*.

The housing 11 has the hollow cylindrical porcelain insulator 12 whose lower end portion is coaxially inserted thereinto. The porcelain insulator 12 is made of an insulating material such as alumina. The housing 11 has the upper end 11*c* which is crimped against the porcelain insulator 12 to make a firm joint of the housing 11 and the porcelain insulator 12. The porcelain insulator 12 has formed in a lower end portion thereof the through hole 12*a* into which the center electrode 13 is firmly retained.

The center electrode 13 is made of a Ni (nickel) alloy which is a base material having a high heat resistance in a cylindrical shape. Specifically, the center electrode 13 is formed by a copper inner layer (i.e., a central layer) and a Ni-base alloy outer layer. The center electrode 13 has a front end portion (i.e., a head) exposed outside the lower end of the porcelain insulator 12 and the lower end of the housing 11.

Figure 2:
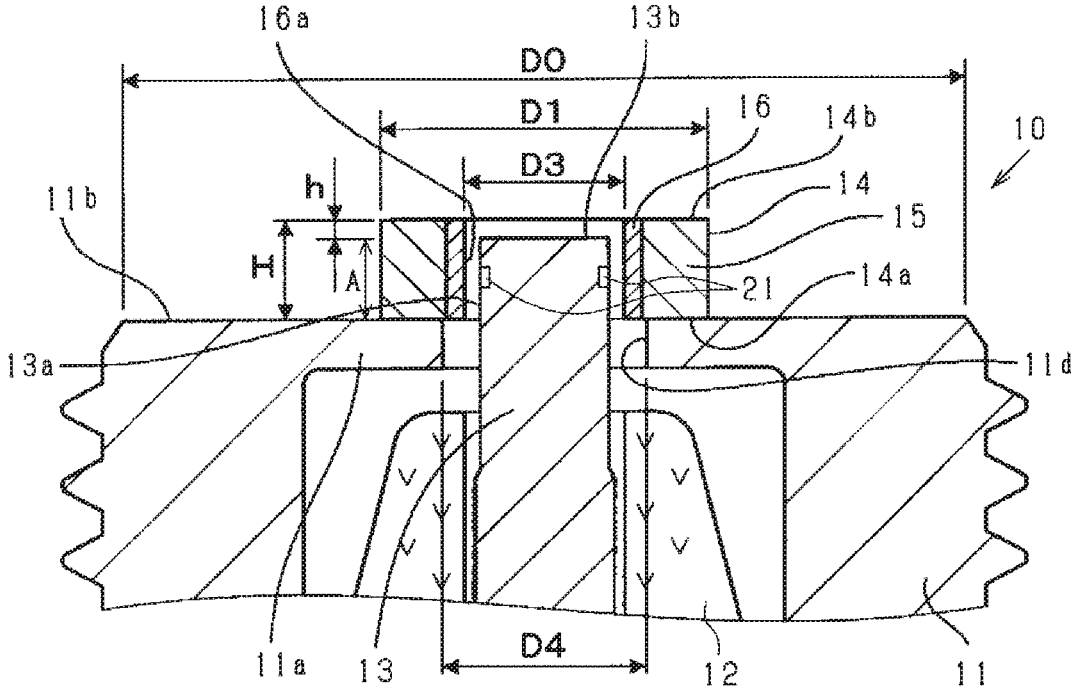
FIG. 2 is an enlarged partial sectional view of the spark plug in FIG. 1.

The ground electrode 14 is, as illustrated in FIG. 2, formed in a hollow cylindrical shape. The ground electrode 14 includes the annular electrode base 15 and the noble metal layer 16 arranged on an inner peripheral surface of the electrode base 15. For instance, the electrode base 15 is made of a Ni base alloy. The noble metal layer 16 is made of a single material of platinum (Pt) or iridium (Ir) or a Pt—Ir alloy. The noble metal layer 16 is joined to the electrode base 15 using a diffusion bonding technique. The noble metal layer 16 has a thickness of, for example, 0.1 mm to 0.5 mm.

The ground electrode 14 has the base end surface 14*a* and the front end surface 14*b* which are opposed to each other and flat. The ground electrode 14 is joined to the housing 11 with the base end surface 14*a* of the ground electrode 14 placed in surface-contact with the front end surface 11*b* of the housing 11.

The ground electrode 14 protrudes from the front end surface 11*b* of the housing 11. The ground electrode 14 is placed to have the inner peripheral surface 16*a* facing the outer peripheral surface 13*a* of the center electrode 13.

The ground electrode 14 has the outer diameter D1 smaller than the outer diameter D0 of the front end surface 11*b* of the housing 11. The outer diameter D1 is 5 mm to 10 mm. The outer diameter D0 is 12 mm to 22 mm. The outer diameter D1 is more preferably 5 mm to 7 mm. The outer diameter D0 is more preferably 14 mm to 22 mm.

The front end surface 14*b* of the ground electrode 14 is located farther away from the base end (i.e., an upper end, as viewed in FIG. 1) of the spark plug 10 than the front end surface 13*b* of the center electrode 13 is. It is preferable that the front end surface 14*b* of the ground electrode 14 is arranged 0.1 mm to 0.6 mm away from the front end surface 13*b* of the center electrode 13 in the lengthwise direction of the spark plug 10 and also located 0.8 mm to 3 mm away from the front end surface 11*b* of the housing 11 in the lengthwise direction of the spark plug 10. An interval h between the front end surface 13*b* of the center electrode 13 and the front end surface 14*b* of the ground electrode 14 in the axial direction of the center electrode 13 (which will merely be referred to as an axial direction), therefore, lies in a range of 0.1 mm to 0.6 mm. A height (i.e., thickness) H of the ground electrode 14 from the front end surface 11*b* of the housing 11, that is, a distance between the front end surface 14*b* and the base end surface 14*a* of the ground electrode 14 in the axial direction is preferably between 0.8 mm to 3 mm. In this embodiment, the interval h is 0.5 mm. The height His 2.0 mm.

The ground electrode 14 has the inner diameter D3 smaller than the inner diameter D4 of the small-diameter portion 11*a* of the housing 11. In this embodiment, the inner diameter D3 is 2.8 mm to 3.4 mm. The inner diameter D4 is 3.6 mm to 4.0 mm. The inner peripheral surface 16*a* of the ground electrode 14 is totally located inside the whole of the inner peripheral surface 11*d* of the small-diameter portion 11*a* of the housing 11 in a radial direction of the center electrode 13 (or the ground electrode 14) which will merely be referred to as a radial direction). In other words, the whole of the inner peripheral surface 16*a* is located closer to the longitudinal center line of the center electrode 13 (i.e., the spark plug 10) than the inner peripheral surface 11*d* is in the radial direction. A distance between the center electrode 13 and the ground electrode 14 is shorter than that between the center electrode 13 and the small-diameter portion 11*a* of the housing 11 in the radial direction, so that a spark is created between the center electrode 13 and the ground electrode 14.

Referring back to FIG. 1, the spark plug 10 has the center shaft 18 and the terminal 19 which are electrically connected to an upper portion of the center electrode 13. The terminal 19 is connected to an external circuit which works to apply high-voltage to the spark plug 10 to develop a spark. The gasket 20 is disposed on an upper end of the thread 11*e* of the housing 11 for use in attachment of the spark plug 10 to the internal combustion engine. When the spark plug 10 is mounted in the internal combustion engine, the center electrode 13 and the ground electrode 14 of the spark plug 10 are exposed to a combustion chamber of the internal combustion engine.

When voltage is applied between the ground electrode 14 and the center electrode 13, it creates electric field in a spark gap between the ground electrode 14 and the center electrode 13. The ground electrode 14 protrudes from the center electrode 13 in the axial direction of the spark plug 10, thereby enhancing concentration of electric field on the front end of the outer peripheral surface 13*a* of the center electrode 13. This facilitates emission of electrons from the center electrode 13, which results in a decrease in voltage required to create discharge in the spark plug 10.

In recent years, however, it has been required to further reduce the above required voltage. In order to meet this requirement, the center electrode 13, as illustrated in FIG. 2, has a plurality of recesses 21 formed in an outer periphery thereof. FIG. 2 emphasizes the depth of the recesses 21 for the sake of visibility thereof.

Each of the recesses 21 has upper and lower ends opposed to each other in the axial direction. The upper end lower ends of each of the recesses 21 are arranged in a center-to-ground electrode facing region A where the outer peripheral surface 13*a* of the center electrode 13 faces or overlaps the inner peripheral surface 16*a* of the ground electrode 14 in the radial direction. In other words, the recesses 21 are located within the center-to-ground electrode facing region A in the axial direction of the spark plug 10. The center-to-ground electrode facing region A extends along the entire circumference of the center electrode 13. Each of the ends of each of the recesses 21 (i.e., each of four sides of the recess 21 when it is rectangular in shape) may be shaped to have a sharp or a round edge. Each of the recesses 21 has right, left, upper, and lower ends opposed to each other in a circumferential direction of the center electrode 13 (which will merely be referred to as a circumferential direction) and the axial direction. Each of the right, left, upper, and lower ends of each of the recesses 21 may have a sharp or a round edge. The electric field is, therefore, concentrated on the ends of the recesses 21 when voltage is applied between the ground electrode 14 and the center electrode 13.

The recesses 21 are arranged away from each other in the circumferential direction. Specifically, the recesses are arrayed at equal intervals away from each other in the circumferential direction of the center electrode 13. The recesses 21 are, as clearly illustrated in FIG. 3, located at the same positions in the axial direction, in other words, aligned with each other in the circumferential direction of the center electrode 13. The outline of each of the recesses 21 is rectangular in shape. For instance, each of the recesses 21 has a dimension or length S of 0.21 mm in the circumferential direction, a dimension or width L of 0.15 mm in the axial direction, and a depth D of 0.05 mm in the radial direction.

Figure 3:
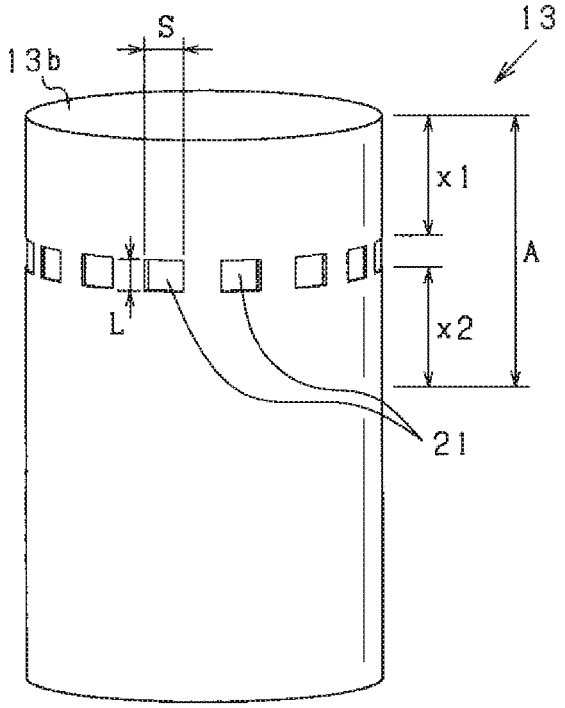
FIG. 3 is a perspective view which illustrates a front portion of a center electrode.

FIG. 4 is a table which demonstrates experimental results using test samples of the spark plug 10 which are designed to have a single recess 21. Specifically, the table represents relations between locations of the recess 21 and ratios of voltage required by the test samples of the spark plug 10 to a reference voltage. The test samples have the following dimensions. The interval h between the front end surface 13*b* of the center electrode 13 and the front end surface 14*b* of the ground electrode 14 in the axial direction of the center electrode 13 is 0.5 mm. The center-to-ground electrode facing region A is selected to have a dimension of 1.5 mm in the axial direction. The circumferential length S of the recess 21 is 0.08 mm. The width L of the recess 21 is 0.15 mm. The depth D of the recess 21 is 0.05 mm. The distance x1 is, as illustrated in FIG. 3, a distance between the front end of the center electrode 13 and the recess 21 in the axial direction. The distance x2 is a distance between the base end of the center-to-ground electrode facing region A (i.e., the ground electrode 14) and the recess 21 in the axial direction. The required voltage ratio is represented by a ratio of a voltage required by each of the test samples to a voltage which is required by a test sample of the spark plug 10 designed not to have the recess 21 and defined as 1.00. The test samples are classified into two types: one having the recess 21 formed in the center electrode 13 and one having the recess 21 formed in the ground electrode 14.

The test samples in a hatched region in FIG. 4 have a required voltage ratio of 0.90 or less. The hatched region shows that when relations of $0.03 \leq x1 \leq 1.33$ and $0.03 \leq x2 \leq 1.33$ in the axial direction are met, in other words, the ends of the recess 21 opposed to each other in the axial direction are located inside the center-to-ground electrode facing region A, the required voltage ratios are approximately 0.90 or less.

FIG. 5 is a table which demonstrates experimental results using test samples of the spark plug 10 which are designed to have a single recess 21. Specifically, the table represents relations between dimensions of the recess 21 and ratios of voltage required by the test samples of the spark plug 10 to a reference voltage. The test samples have the following dimensions. The interval h between the front end surface 13*b* of the center electrode 13 and the front end surface 14*b* of the ground electrode 14 in the axial direction of the center electrode 13 is 0.5 mm. The center-to-ground electrode facing region A is selected to have a dimension of 1.5 mm in the axial direction. A distance between the front end of the center electrode 13 and the center of the recess 21 in the axial direction is 0.95 mm. The depth D of the recess 21 is 0.05 mm. The required voltage ratio is represented by a ratio of a voltage required by each of the test samples to a voltage which is required by a test sample of the spark plug 10 designed not to have the recess 21 and defined as 1.00.

The test samples in a hatched region in FIG. 5 have a required voltage ratio of 0.90 or less. The hatched region shows that when relations of $0.06 \leq S \leq 1.26$ and $0.10 \leq L \leq 1.20$ are met, in other words, when the circumferential length S of the recess 21 is 0.06 mm or more, the width L of the recess 21 in the axial direction is 0.10 mm or more, and the ends of the recess 21 opposed to each other in the axial direction lie on or inside limits of the center-to-ground electrode facing region A in the axial direction, the required voltage ratios are approximately 0.90 or less.

Figures 6, 7:
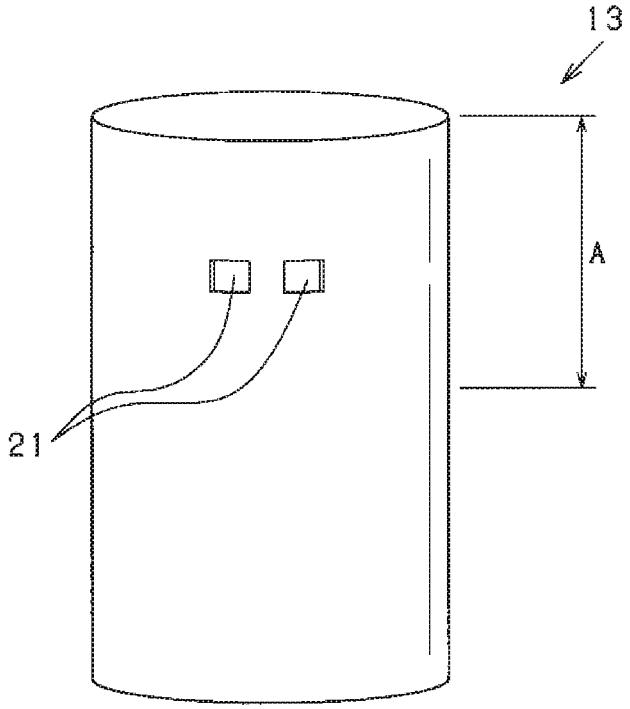
FIG. 6 is a table which represents a relation between a depth of a recess and a ratio of voltage required by a spark plug to create sparks to a reference voltage.
FIG. 7 is a perspective view which illustrates a modification of a front end portion of a center electrode.

FIG. 6 is a table which demonstrates experimental results using test samples of the spark plug 10 which are designed to have a single recess 21. Specifically, the table represents relations between depths D of the recess 21 and ratios of voltage required by the test samples of the spark plug 10 to a reference voltage. The test samples have the following dimensions. The interval h between the front end surface 13*b* of the center electrode 13 and the front end surface 14*b* of the ground electrode 14 in the axial direction of the center electrode 13 is 0.5 mm. The center-to-ground electrode facing region A is selected to have a dimension of 1.5 mm in the axial direction. A distance between the front end of the center electrode 13 and the center of the recess 21 in the axial direction is 0.95 mm. The circumferential length S of the recess 21 is 0.08 mm. The width L of the recess 21 in the axial direction is 0.15 mm. The required voltage ratio is expressed by a ratio of a voltage required by each of the test samples to a voltage which is required by a test sample of the spark plug 10 designed not to have the recess 21 and defined as 1.00.

The test samples in a hatched region in FIG. 6 have a required voltage ratio of 0.90 or less. The hatched region shows that when a relationship of $0.04 \leq D$ is met, the required voltage ratios are approximately 0.90 or less.

The structurer of the spark plug 10 in this embodiment offers the following beneficial advantages.

The center electrode 13, as described above, has the recesses 21 formed in the outer periphery thereof. The recesses 21 are arranged to have the axially opposed ends lying in the center-to-ground electrode facing region A wherein the outer peripheral surface 13*a* of the center electrode 13 faces the inner peripheral surface 16*a* of the ground electrode 14 in the radial direction of the center electrode 13. This results in concentration of electrical charge on the ends of the recesses 21 opposed to each other in the axial direction of the center electrode 13, thereby facilitating discharge of electrons from the center electrode 13, which results in a decrease in voltage required to create discharge in the spark plug 10.

Each of the recesses 21 also has ends which are opposed to each other in the circumferential direction of the center electrode 13 and located inside the center-to-ground electrode facing region A. This results in concentration of electrical charge on the ends of the recesses 21 opposed to each other in the circumferential direction of the center electrode 13, thereby facilitating discharge of electrons from the center electrode 13, which results in a decrease in voltage required to create discharge in the spark plug 10.

The plurality of recesses 21 are arranged at given intervals away from each other in the circumferential direction of the center electrode 13, thereby resulting in an increase in places which are arranged in the circumferential direction and where electric field concentrates. This also results in a decrease in voltage required to achieve discharge in the spark plug 10. The recesses 21 are arrayed at equal intervals away from each other in the circumferential direction of the center electrode 13 and located at the same position on the length of the center electrode 13, in other words, at the same distance from either of the ends of the center electrode 13 in the axial direction, thereby eliminating a risk that sparks are created locally at one(s) of the recesses 21.

Each of the recesses 21 is shaped to have the length S of 0.06 mm or more in the circumferential direction of the center electrode 13 and the width L of 0.10 mm or more in the axial direction of the center electrode 13. Each of the recesses 21 also has the ends which are opposed to each other in the axial direction of the center electrode 13 and arranged in coincidence with or inside the limits or ends of the center-to-ground electrode facing region A in the axial direction of the center electrode 13. Each of the recesses 21 also has the depth D of 0.04 mm or more in the peripheral surface of the center electrode 13. It is apparent from the tables in FIGS. 4 to 6 that the above dimensions of the recesses 21 contribute to a reduction in voltage required by the spark plug 10 to develop sparks.

The recesses 21 are formed in the outer periphery close to the edge of the center electrode 13, which enables the recesses 21 to be machined from outside the center electrode 13. This facilitates ease with which the recesses 21 are formed as compared with when the recesses 21 are machined in the inner periphery of the center electrode 13.

The spark plug 10 in the above embodiment may be modified in the following ways. The same reference numbers as employed in the above embodiment refer to the same parts, and explanation thereof in detail will be omitted here.

FIG. 7 shows the center electrode 13 equipped with a plurality of recesses 21 (two recesses 21 in the illustrated example) which are arranged in a portion of the outer peripheral surface of the center electrode 13. The recesses 21 are aligned in the circumferential direction of the center electrode 13. The center electrode 13 may alternatively have the single recess 21 formed therein.

Figure 8:
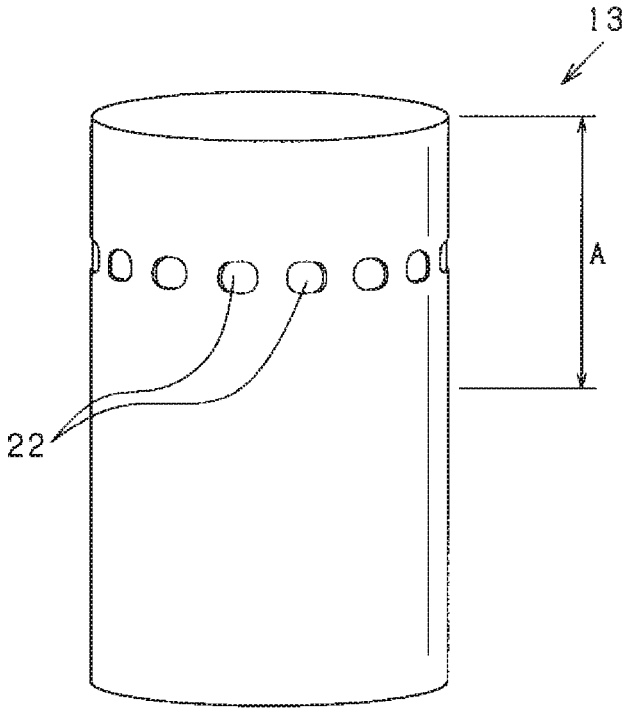
FIG. 8 is a perspective view which illustrates the second modification of a front end portion of a center electrode.

FIG. 8 illustrates the center electrode 13 which has the recesses 22 formed close to the edge of the outer periphery thereof. Each of the recesses 22 is in an oval or ellipse shape and lies in the center-to-ground electrode facing region A. The recesses 22 are located fully inside the center-to-ground electrode facing region A, thereby enhancing the concentration of electrical filed on outer edges of the recesses 22.

Figure 9:
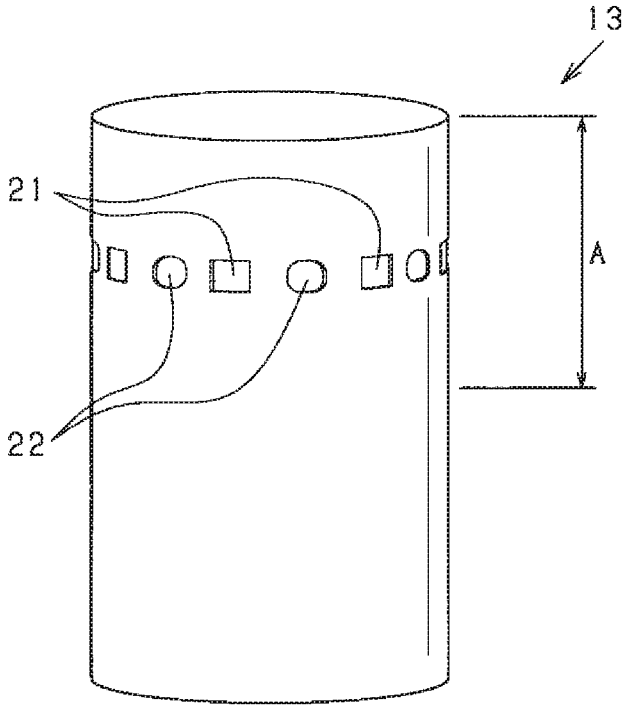
FIG. 9 is a perspective view which illustrates the third modification of a front end portion of a center electrode.

FIG. 9 illustrates the center electrode 13 which has two types of recesses different in shape from each other: one being the rectangular recesses 21 and the other being the oval or ellipsoidal recesses 22 which are formed close to the edge of the outer periphery thereof within the center-to-ground electrode facing region A. The recesses 21 and 22 are arranged alternately in the circumferential direction of the center electrode 13.

Figure 10:
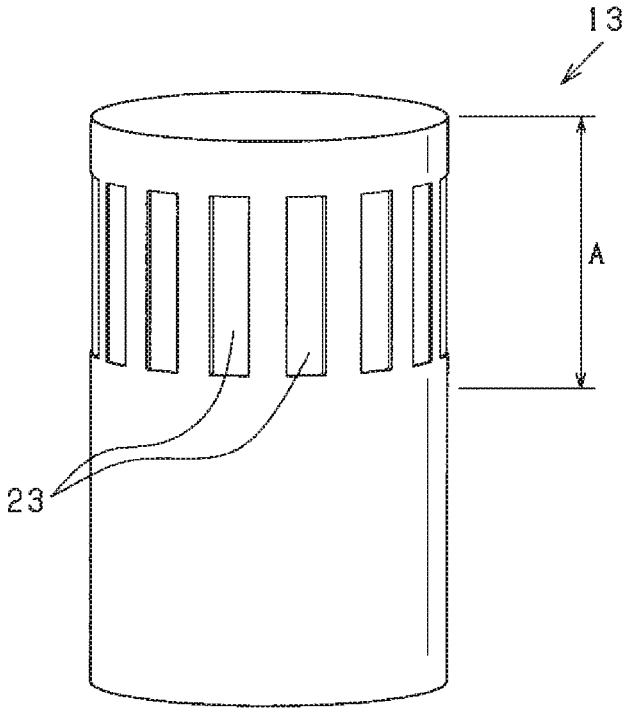
FIG. 10 is a perspective view which illustrates the fourth modification of a front end portion of a center electrode.

FIG. 10 illustrates the center electrode 13 equipped with the recesses 23 which are formed close to the edge of the outer periphery thereof in the form of grooves extending substantially parallel to the axial direction of the center electrode 13. Specifically, each of the recesses 23 has a length extending in the axial direction of the center electrode 13 and lies fully inside the center-to-ground electrode facing region A. Each of the recesses 23 may alternatively be shaped to have a length whose half or more lies within the center-to-ground electrode facing region A. The configuration of the recesses 23 increases an area of the center electrode 13 where the electrical field concentrates in the axial direction of the center electrode 13, thereby decreasing the voltage required to develop sparks in the spark plug 10.

Figure 11:
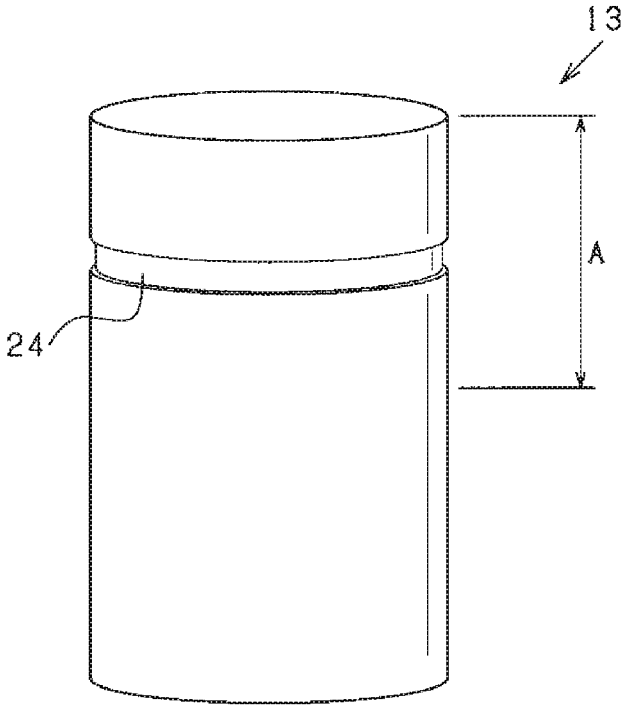
FIG. 11 is a perspective view which illustrates the fifth modification of a front end portion of a center electrode.

FIG. 11 illustrates the center electrode 13 equipped with a single recess 24 shaped in the form of a circular groove. The recess 24 extends over the whole of a circumference of the center electrode 13 and is arranged close to the edge of the center electrode 13 within the center-to-ground electrode facing region A. This increases an area of the center electrode 13 where the electrical field concentrates in the circumferential direction of the center electrode 13, thereby decreasing the voltage required to develop sparks in the spark plug 10.

Figure 12:
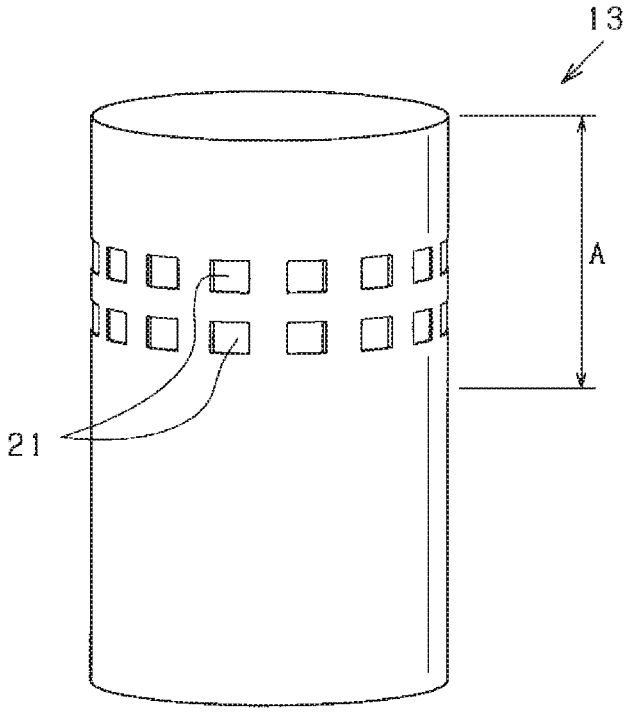
FIG. 12 is a perspective view which illustrates the sixth modification of a front end portion of a center electrode.

FIG. 12 illustrates the center electrode 13 equipped with two arrays (which will also be referred to as an upper and a lower array) of recesses 21 formed in the outer periphery thereof. The recesses 21 are all located within the center-to-ground electrode facing region A. The upper array of the recesses 21 is arranged at a given interval away from the lower array of the recesses 21 in the axial direction of the center electrode 13.

Figure 13:
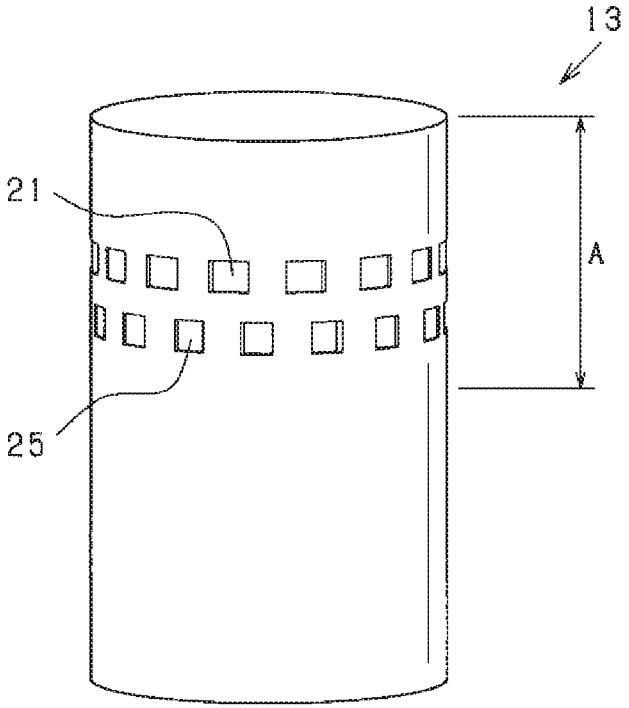
FIG. 13 is a perspective view which illustrates the seventh modification of a front end portion of a center electrode.

FIG. 13 illustrates the center electrode 13 equipped with an upper array of recesses 21 and a lower array of recesses 25 formed in the outer periphery thereof. The recesses 21 and 15 are all located within the center-to-ground electrode facing region A. The upper array of the recesses 21 is arranged at a given interval away from the lower array of the recesses 25 in the axial direction of the center electrode 13. Each of the recesses 21 is arranged out of alignment with every one of the recesses 25 in the axial direction of the center electrode 13. In other words, the recesses 21 are arranged at locations different from those of the recesses 15 in the circumferential direction of the center electrode 13.

Figure 14:
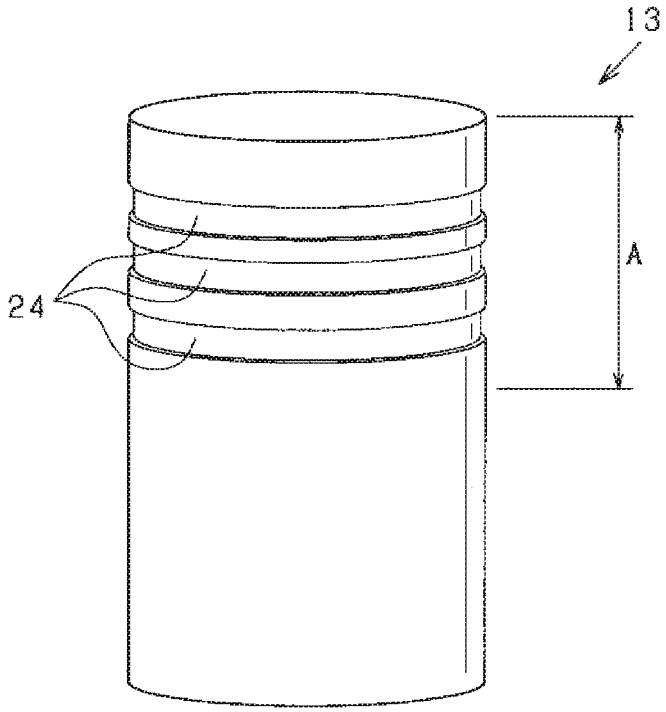
FIG. 14 is a perspective view which illustrates the eighth modification of a front end portion of a center electrode.

FIG. 14 illustrates the center electrode 13 equipped with three recesses 24 shaped in the form of circular grooves in the outer periphery thereof. The recesses 24 are all located within the center-to-ground electrode facing region A. Each of the recesses 24 has a length extending over the whole of a circumference of the center electrode 13. The recesses 24 are arranged at a given interval away from each other in the axial direction of the center electrode 13.

The structures of the center electrode 13 in FIGS. 12 to 14 increase the number of places where electric field concentrates, thereby resulting in a decrease in voltage required to achieve discharge in the spark plug 10.

Figure 15:
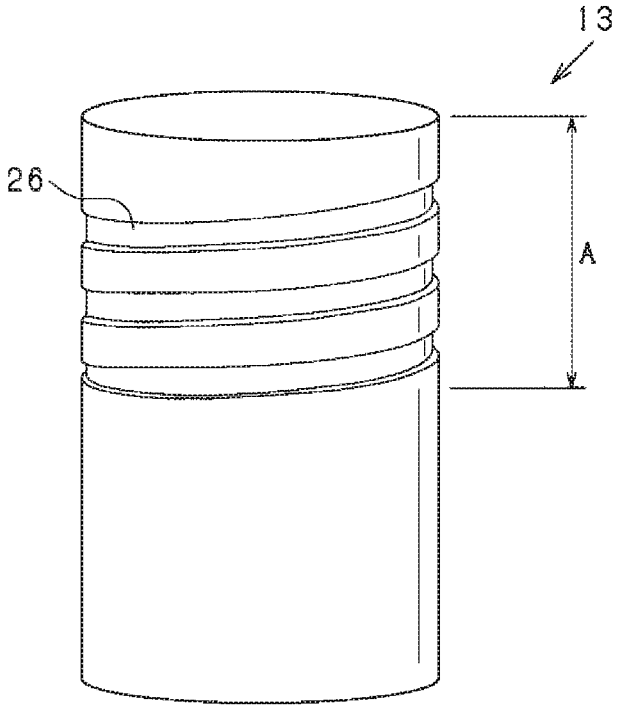
FIG. 15 is a perspective view which illustrates the ninth modification of a front end portion of a center electrode.

FIG. 15 illustrates the center electrode 13 which has the recess 26 in the form of a spiral groove in the outer periphery thereof within the center-to-ground electrode facing region A.

The spiral recess 26 contributes to an increase in area of the center electrode 13 where the electrical field concentrates in the circumferential and axial directions, thereby resulting in a decrease in voltage required to achieve discharge in the spark plug 10.

Figure 16:
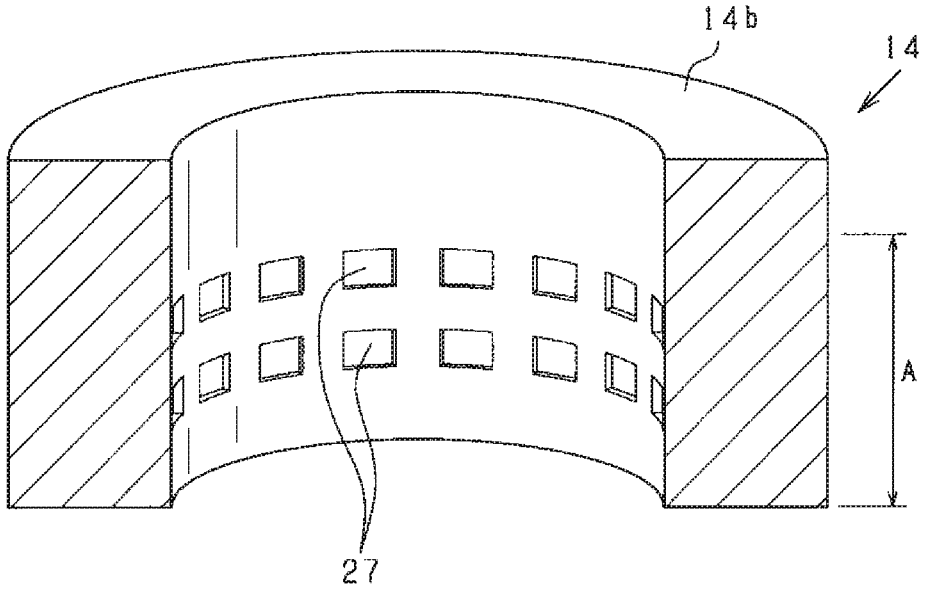
FIG. 16 is a perspective view which illustrates a modification of a ground electrode.

FIG. 16 illustrates the ground electrode 14 which has two arrays (which will also be referred to as an upper and a lower array) of recesses 27 formed in an inner periphery thereof within the center-to-ground electrode facing region A. The layout and configuration of the recesses 27 are similar to those of the recesses 21 illustrated in FIG. 12. The recesses 27 formed in the ground electrode 14 also contribute to a decrease in voltage required to achieve discharge in the spark plug 10.

Figure 17:
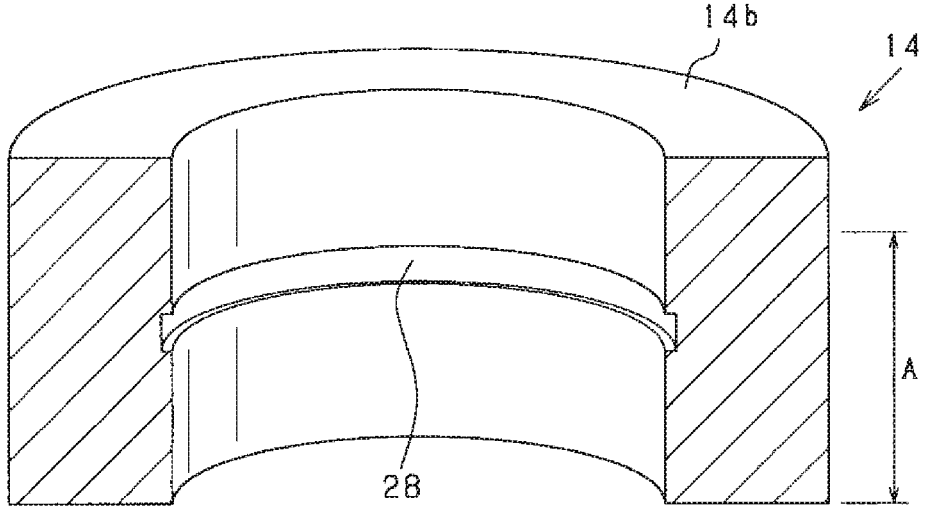
FIG. 17 is a perspective view which illustrates the second modification of a ground electrode.

FIG. 17 illustrates the ground electrode 14 which has a single recess 28 formed in the shape of a circular groove in the inner periphery thereof within the center-to-ground electrode facing region A. The layout and configuration of the recess 28 are similar to those of the recess 24 illustrated in FIG. 11. The recess 24 formed in the ground electrode 14 also contribute to a decrease in voltage required to achieve discharge in the spark plug 10.

Figure 18:
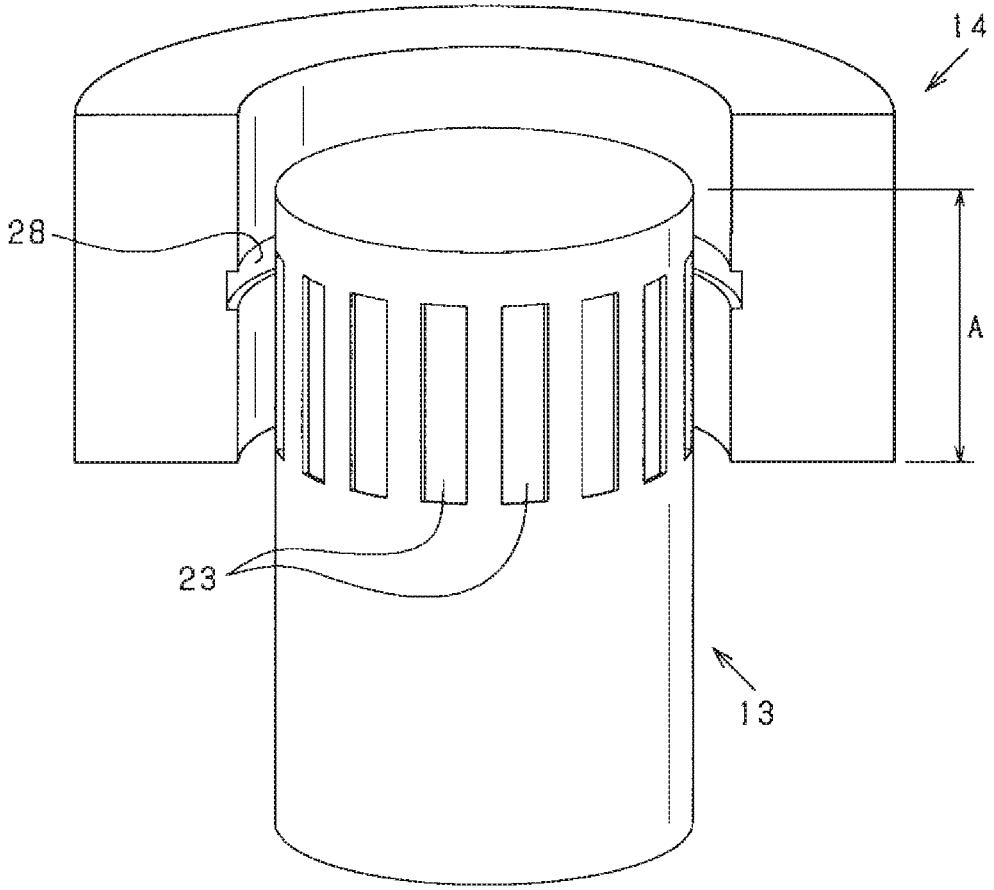
FIG. 18 is a perspective view which illustrates a modification of a combination of a center electrode and a ground electrode.

FIG. 18 illustrates the center electrode 13 with the recesses 23 formed in the outer periphery thereof and the ground electrode 14 with the recess 28 formed in the inner periphery thereof within the center-to-ground electrode facing region A. Specifically, the spark plug 10 in FIG. 18 has a combination of the center electrode 13 illustrated in FIG. 10 and the ground electrode 14 illustrated in FIG. 17. This structure also contributes to an increase in area of the center electrode 13 and the ground electrode 14 where the electrical field concentrates, thereby resulting in a decrease in voltage required to achieve discharge in the spark plug 10.

Figure 19:
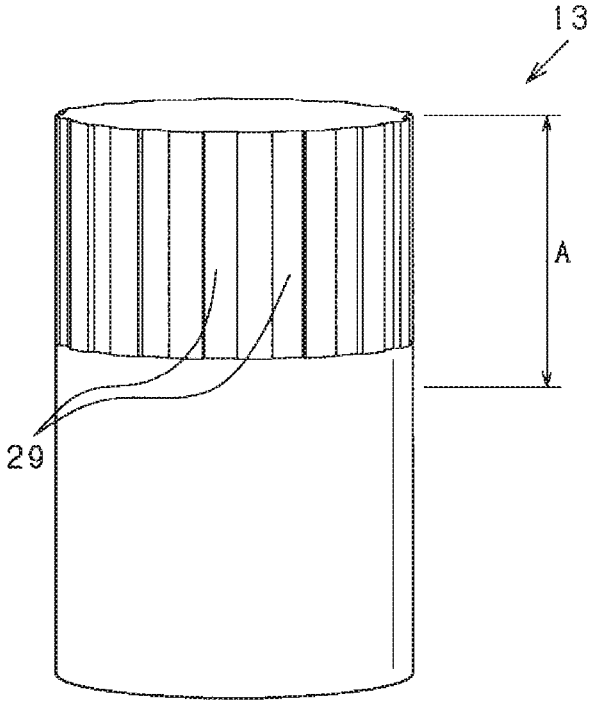
FIG. 19 is a perspective view which illustrates the tenth modification of a front end portion of a center electrode.

FIG. 19 illustrates the center electrode 13 which has recesses 29 formed in the shape of grooves in the outer periphery thereof. Each of the recesses 29 has a length extending in the axial direction of the center electrode 13 within the center-to-ground electrode facing region A. Each of the recesses 29 may alternatively be shaped to have at least a portion lying in the center-to-ground electrode facing region A.

Figure 20:
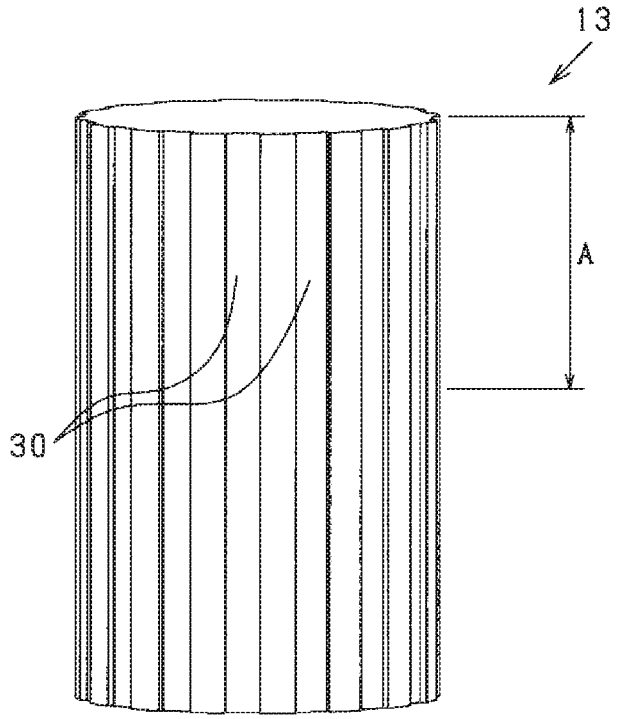
FIG. 20 is a perspective view which illustrates the eleventh modification of a front end portion of a center electrode.

FIG. 20 illustrates the center electrode 13 which has recesses 30 formed in the shape of grooves in the outer periphery thereof. Each of the recesses 30 has a length extending in the axial direction of the center electrode 13. Each of the recesses 30 is shaped to have only a portion lying in the center-to-ground electrode facing region A. The recesses 30 are arranged at given intervals away from each other in the circumferential direction of the center electrode 13.

Figure 21:
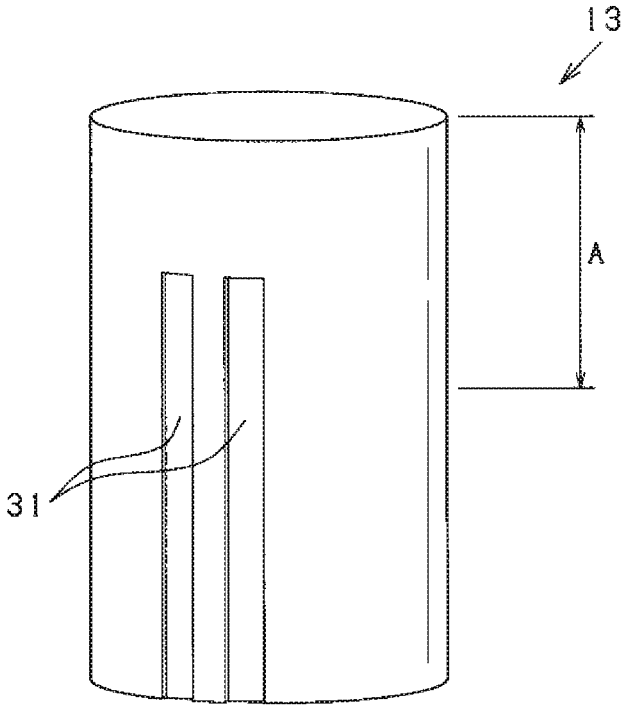
FIG. 21 is a perspective view which illustrates the twelfth modification of a front end portion of a center electrode.

FIG. 21 illustrates the center electrode 13 which has two recesses 31 formed in the shape of grooves in the outer periphery thereof. Each of the recesses 30 has a length extending in the axial direction of the center electrode 13. Each of the recesses 30 is shaped to have only a portion lying in the center-to-ground electrode facing region A.

Figure 22:
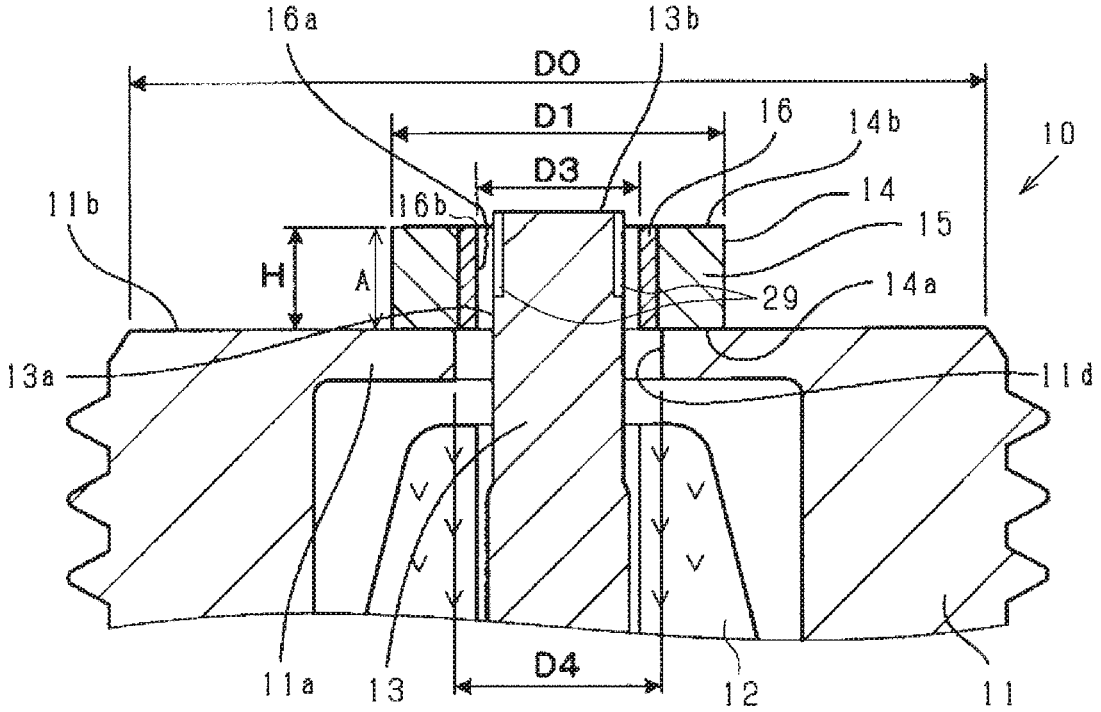
FIG. 22 is a partially sectional view which illustrates a modification of a spark plug according to an embodiment.

FIG. 22 illustrates a modification of the spark plug 10 which has the front end surface 13*b* of the center electrode 13 protruding outside the front end surface 14*b* of the ground electrode 14 in the axial direction of the spark plug 10. This structure facilitates the concentration of electrical filed on the front edge 16*b* of the inner peripheral surface 16*a* of the ground electrode 14 and is thus useful for the center electrode 13 equipped with, for example, the recesses 29 or 30 formed close to the edge (i.e., the front end) of the outer periphery thereof.

The outer peripheral surface 13*a* of the center electrode 13 of the spark plug 10 has a radius of curvature smaller than the inner peripheral surface 16*a* of the ground electrode 14. The center electrode 13 illustrated in FIG. 19, 20, or 21 has the recesses 29, 30, or 31 formed in the outer periphery thereof, thereby enhancing the concentration of electrical field on the ends of the recesses 29, 30, or 31 lying within the center-to-ground electrode facing region A, which facilitates discharge of electrons from the center electrode 13, thereby resulting in a decrease in voltage required to create discharge in the spark plug 10.

The recesses 29, 30, or 31 are shaped to extend to at least one of the ends of the center-to-ground electrode facing region A in the axial direction of the center electrode 13. This results in an increase in area of the center electrode 13 where the electrical field concentrates, thereby decreasing the voltage required to create sparks in the spark plug 10.

Figure 23:
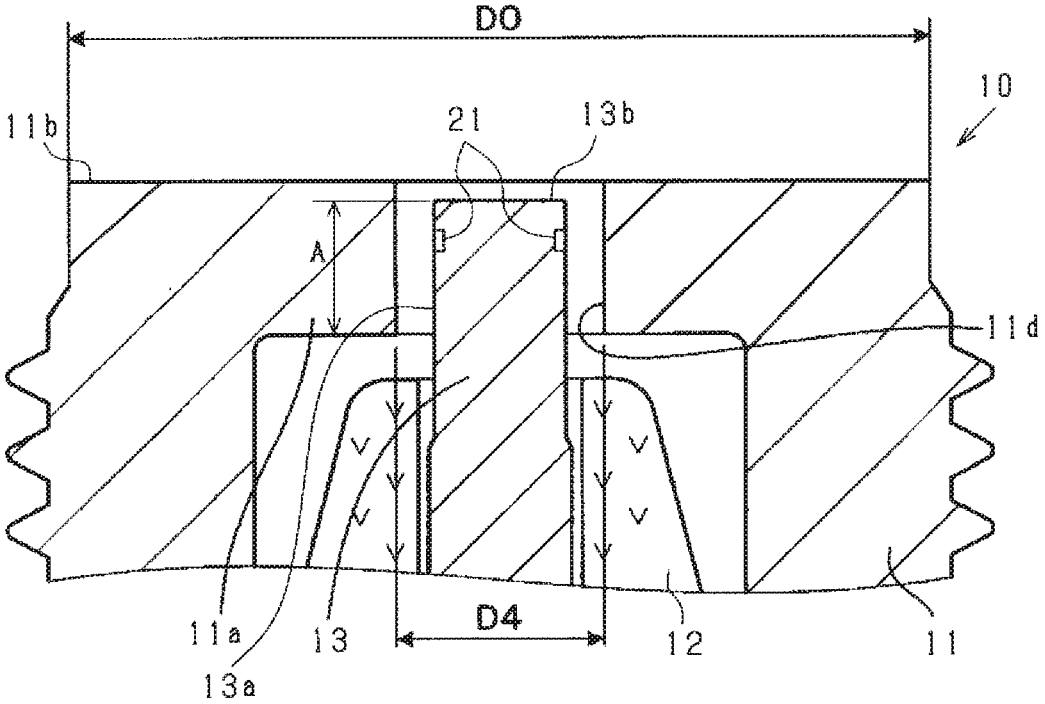
FIG. 23 is a partially sectional view which illustrates another modification of a spark plug according to an embodiment.

The spark plug 10 may be, as illustrated in FIG. 23, designed not to have the ground electrode 14 disposed on the front end surface 11*b* of the housing 11. In this structure, the small-diameter portion 11*a* of the housing 11 serves as a ground electrode. The small-diameter portion 11*a* is joined to the housing 11 (i.e., a metal shell) and has the cylindrical inner peripheral surface 11*d* facing the outer peripheral surface 13*a* of the center electrode 13. The center electrode 13 has the recesses 21 fully lying in the center-to-ground electrode facing region A where the outer peripheral surface 13*a* faces the inner peripheral surface 11*d* of the small-diameter portion 11*a* in the radial direction of the center electrode 13. This structure offers substantially the same beneficial advantages as those described in the above embodiments.

The center electrode 13 may be designed to have a noble metal layer disposed on an outer peripheral surface thereof. In this case, recess may be formed close to an edge of the outer peripheral surface of the center electrode 13.

While the present invention has been disclosed in terms of the preferred embodiments in order to facilitate better understanding thereof, it should be appreciated that the invention can be embodied in various ways without departing from the principle of the invention. Therefore, the invention should be understood to include all possible embodiments and modifications to the shown embodiments which can be embodied without departing from the principle of the invention as set forth in the appended claims.

What is claimed is:

1. A spark plug comprising:

a hollow cylindrical metal shell;

a cylindrical center electrode disposed in the metal shell;

a ground electrode which is joined to the metal shell and has a cylindrical inner peripheral surface facing an outer peripheral surface of the center electrode; and at least one recess which is formed in at least one of the outer peripheral surface of the center electrode and the inner peripheral surface of the ground electrode, wherein the recess has ends lying within a center-to-ground electrode facing region where the outer peripheral surface of the center electrode faces the inner peripheral surface of the ground electrode in a radial direction of the center electrode; and, the recess has a circumferential dimension of 0.06 mm or more and an axial dimension of 0.10 mm or more, wherein the recess has a dimension in an axial direction of a corresponding one of the ground electrode and the center electrode so as to have the ends coinciding with or inside ends of the center-to-ground electrode facing region in the axial direction, and wherein the recess has a depth of 0.04 mm or more.

2. A spark plug as set forth in claim 1, wherein a plurality of recesses are formed in at least one of the outer peripheral surface of the center electrode and the inner peripheral surface of the ground electrode, and wherein the recesses are arranged at given intervals away from each other in a circumferential direction of a corresponding one of the ground electrode and the center electrode.

3. A spark plug as set forth in claim 1, wherein the recess extends over an entire circumference of one of the outer peripheral surface of the center electrode and the inner peripheral surface of the ground electrode.

4. A spark plug as set forth in claim 1, wherein the at least one recess includes a plurality of recesses arranged at a given interval away from each other in an axial direction of one of the center electrode and the ground electrode.

5. A spark plug as set forth in claim 1, wherein the recess is formed in the outer peripheral of the center electrode.

6. A spark plug as set forth in claim 1, wherein the at least one recess includes a plurality of recesses formed in the outer peripheral surface of the center electrode and the inner peripheral surface of the ground electrode.

7. A spark plug comprising:

a hollow cylindrical metal shell;

a cylindrical center electrode disposed in the metal shell;

a ground electrode which is joined to the metal shell and has a cylindrical inner peripheral surface facing an outer peripheral surface of the center electrode; and at least one recess which is formed in the outer peripheral surface of the center electrode, wherein the recess has at least a portion lying within a center-to-ground electrode facing region where the outer peripheral surface of the center electrode faces the inner peripheral surface of the ground electrode in a radial direction of the center electrode; and, the recess extends to at least one of ends of the center-to-ground electrode facing region in an axial direction of the center electrode.

* * * * *